US010894192B2

(12) United States Patent
Ban

(10) Patent No.: US 10,894,192 B2
(45) Date of Patent: Jan. 19, 2021

(54) GOLF CLUB HEAD AND MANUFACTURING METHOD THEREOF

(71) Applicant: Bridgestone Sports Co., Ltd., Tokyo (JP)

(72) Inventor: Wataru Ban, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 16/410,144

(22) Filed: May 13, 2019

(65) Prior Publication Data

US 2019/0388742 A1 Dec. 26, 2019

(30) Foreign Application Priority Data

Jun. 22, 2018 (JP) ..... 2018-119205

(51) Int. Cl.
*A63B 53/04* (2015.01)

(52) U.S. Cl.
CPC ..... *A63B 53/04* (2013.01); *A63B 53/047* (2013.01); *A63B 53/0445* (2020.08); *A63B 53/0466* (2013.01)

(58) Field of Classification Search
CPC ... A63B 53/04; A63B 53/0466; A63B 53/047; A63B 2053/0445
USPC ..... 473/331, 345
See application file for complete search history.

(56) References Cited

U.S. PATENT DOCUMENTS

| | | | | |
|---|---|---|---|---|
| 8,449,406 | B1 * | 5/2013 | Frame | A63B 53/04 473/329 |
| 8,827,833 | B2 | 9/2014 | Amano et al. | |
| 8,858,361 | B2 | 10/2014 | Ripp et al. | |
| 8,979,670 | B2 | 3/2015 | Aguayo et al. | |
| 9,308,422 | B2 | 4/2016 | Ripp et al. | |
| 9,539,477 | B2 | 1/2017 | Ripp et al. | |
| 9,579,550 | B2 | 2/2017 | Aguayo et al. | |
| 9,636,757 | B1 * | 5/2017 | Rice | A63B 53/047 |
| 9,814,951 | B2 | 11/2017 | Ripp et al. | |
| 9,950,225 | B2 | 4/2018 | Aguayo et al. | |
| 9,975,015 | B2 | 5/2018 | Ripp et al. | |
| 2013/0053171 | A1 * | 2/2013 | Carlyle | A63B 53/047 473/331 |
| 2013/0225319 | A1 * | 8/2013 | Kato | A63B 53/047 473/331 |
| 2016/0361607 | A1 * | 12/2016 | Huang | A63B 53/04 |
| 2017/0100792 | A1 | 4/2017 | Huang et al. | |

(Continued)

FOREIGN PATENT DOCUMENTS

| | | | |
|---|---|---|---|
| JP | 2015-186513 | A | 10/2015 |
| JP | 2016-007537 | A | 1/2016 |

(Continued)

*Primary Examiner* — Michael D Dennis
(74) *Attorney, Agent, or Firm* — Sughrue Mion, PLLC

(57) ABSTRACT

A golf club head includes a face portion, a plurality of score lines formed in the face portion and extending in a toe-heel direction, a plurality of convex portions formed in the face portion and extending in the toe-heel direction between the score lines adjacent to each other in a vertical direction of the face portion, and at least one concave portion formed in the face portion and extending in the toe-heel direction between the convex portions adjacent to each other in the vertical direction. A flat surface is formed between the concave portion and the convex portion adjacent to the concave portion.

2 Claims, 6 Drawing Sheets

(56) References Cited

U.S. PATENT DOCUMENTS

| | | | |
|---|---|---|---|
| 2018/0036606 | A1 | 2/2018 | Sclafani |
| 2018/0236315 | A1 | 8/2018 | Aguayo et al. |
| 2018/0243617 | A1 | 8/2018 | Ripp et al. |

FOREIGN PATENT DOCUMENTS

| | | | |
|---|---|---|---|
| JP | 6065376 | B2 | 1/2017 |
| JP | 6183191 | B2 | 8/2017 |
| JP | 6257635 | B2 | 1/2018 |

* cited by examiner

GOLF CLUB HEAD AND MANUFACTURING METHOD THEREOF

CROSS-REFERENCE TO RELATED APPLICATION(S)

This application claims priority to and the benefit of Japanese Patent Application No. 2018-119205 filed on Jun. 22, 2018, the entire disclosure of which is incorporated herein by reference.

BACKGROUND OF THE INVENTION

Field of the Invention

The present invention relates to a golf club head.

Description of the Related Art

There have been proposed golf club heads each of which includes a face portion in which grooves, concave portions, and convex portions thinner than score lines are formed (for example, US-2018-0036606 and US-2017-0100792, Japanese Patent Laid-Open No. 2016-007537, Japanese Patent Nos. 6257635 and 6183191, Japanese Patent Laid-Open No. 2015-186513, and Japanese Patent No. 6065376). These grooves and the like are effective for increasing the spin amount on a struck ball or preventing a decrease in spin amount in, for example, rainy weather.

However, conventional golf club heads have room for improvement in terms of the spin amount on a struck ball.

SUMMARY OF THE INVENTION

It is an object of the present invention to improve the spin amount on a struck ball.

According to an aspect of the present invention, there is provided a golf club head that includes a face portion, comprising: a plurality of score lines formed in the face portion and extending in a toe-heel direction; a plurality of convex portions formed in the face portion and extending in the toe-heel direction between the score lines adjacent to each other in a vertical direction of the face portion; and at least one concave portion formed in the face portion and extending in the toe-heel direction between the convex portions adjacent to each other in the vertical direction, wherein a flat surface is formed between the concave portion and the convex portion adjacent to the concave portion.

According to another aspect of the present invention, there is provided a golf club head that includes a face portion, comprising: a plurality of score lines formed in the face portion and extending in a toe-heel direction; a plurality of convex portions formed in the face portion and extending in the toe-heel direction between the score lines adjacent to each other in a vertical direction of the face portion; and at least one concave portion formed in the face portion and extending in the toe-heel direction between the convex portions adjacent to each other in the vertical direction, wherein the convex portion is formed on a base material of the face portion, the base material of the face portion is covered with a plating layer, and the concave portion is formed not in the base material but in the plating layer.

According to still another aspect of the present invention, there is provided a manufacturing method of a golf club head including a face portion, the golf club head including a plurality of score lines formed in the face portion and extending in a toe-heel direction, a plurality of convex portions formed in the face portion and extending in the toe-heel direction between the score lines adjacent to each other in a vertical direction of the face portion, and at least one concave portion formed in the face portion and extending in the toe-heel direction between the convex portions adjacent to each other in the vertical direction, the manufacturing method comprising: covering a base material of the face portion, in which the convex portions have been formed, with a plating layer; and forming the concave portion after the covering.

Further features of the present invention will become apparent from the following description of exemplary embodiments with reference to the attached drawings.

DESCRIPTION OF THE EMBODIMENTS

Figure 1:
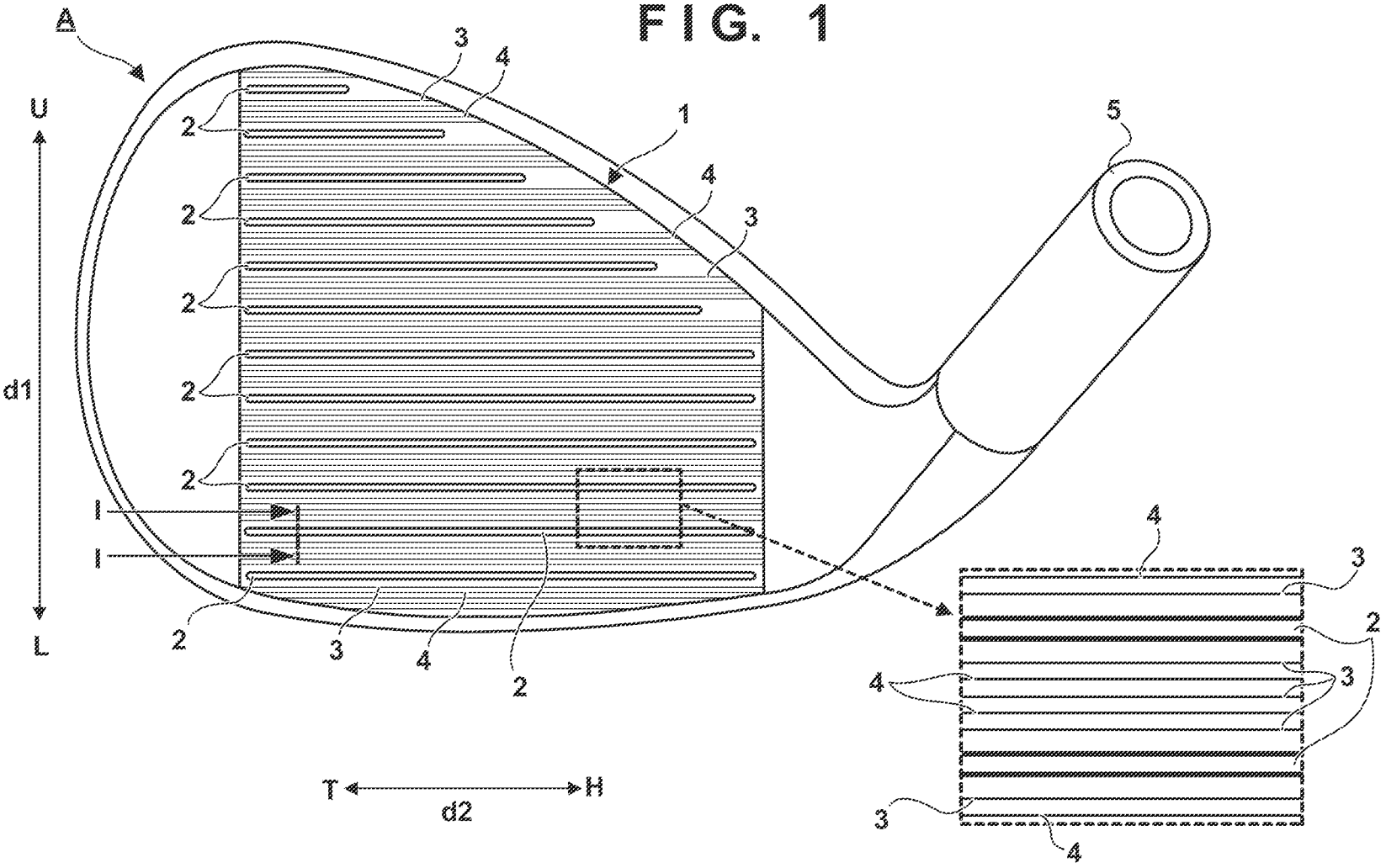
FIG. 1 shows an external view and a partial enlarged view of a golf club head according to an embodiment of the present invention.

FIG. 1 shows an external view and a partial enlarged view of a golf club head A according to an embodiment of the present invention. FIG. 1 illustrates an example in which the present invention is applied to an iron type golf club head. The present invention is suitable for an iron type golf club head and, more particularly, for middle iron, short iron, and wedge type golf club heads. More specifically, the present invention is suitable for manufacturing a golf club head with a loft angle of 30° (inclusive) to 70° (inclusive) and a head weight of 240 g (inclusive) to 320 g (inclusive). However, the present invention is also applicable to wood type and utility (hybrid) type golf club heads.

The golf club head A includes a face portion 1 and a hosel portion 5. The face portion 1 forms a striking surface for striking a golf ball. A shaft (not shown) is attached to the hosel portion 5. In FIG. 1, an arrow d2 indicates a toe-heel direction, and reference symbols T and H indicate the toe side and the heel side, respectively. An arrow d1 indicates a vertical direction (top-sole direction) perpendicular to the toe-heel direction and along the face portion 1. Reference symbols U and L indicate the upper side and the lower side, respectively, upon grounding the sole portion of the head A.

A plurality of score lines 2, a plurality of convex portions 3, and a plurality of concave portions 4 are formed in the face portion 1. The concave portion 4 is a groove with a dimension different from that of the score line 2. In this embodiment, the concave portion 4 is a groove thinner than the score line 2.

Figure 2:
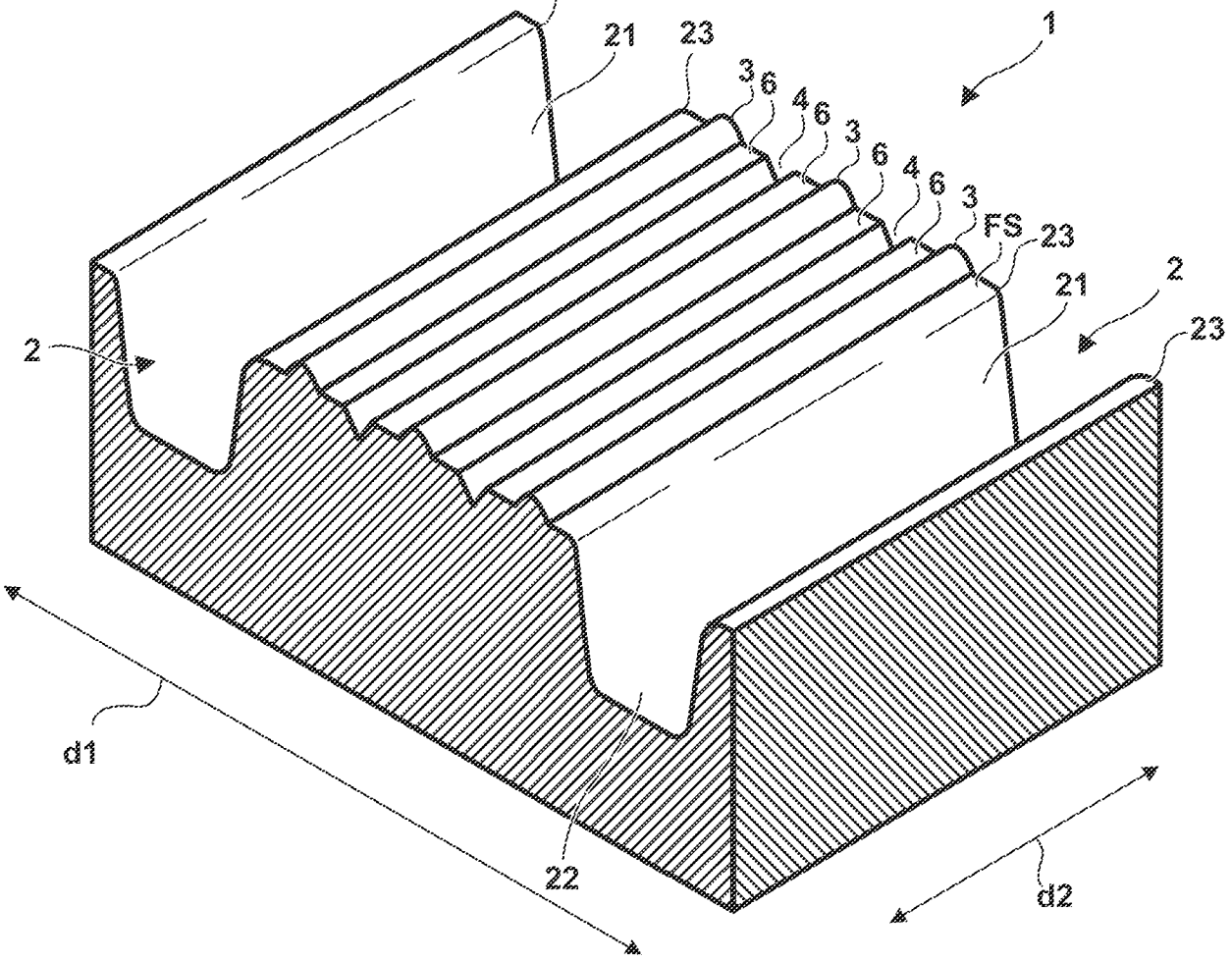
FIG. 2 is a partial sectional perspective view of the golf club head shown in FIG. 1.
Figure 3A:
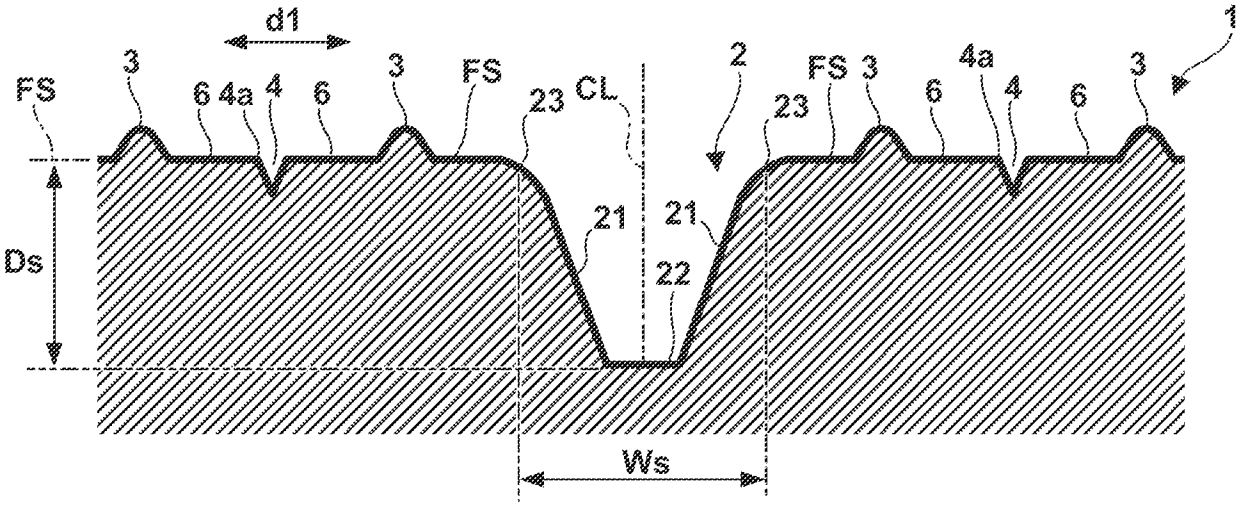
FIG. 3A is a sectional view of the golf club head shown in FIG. 1.
Figure 3B:
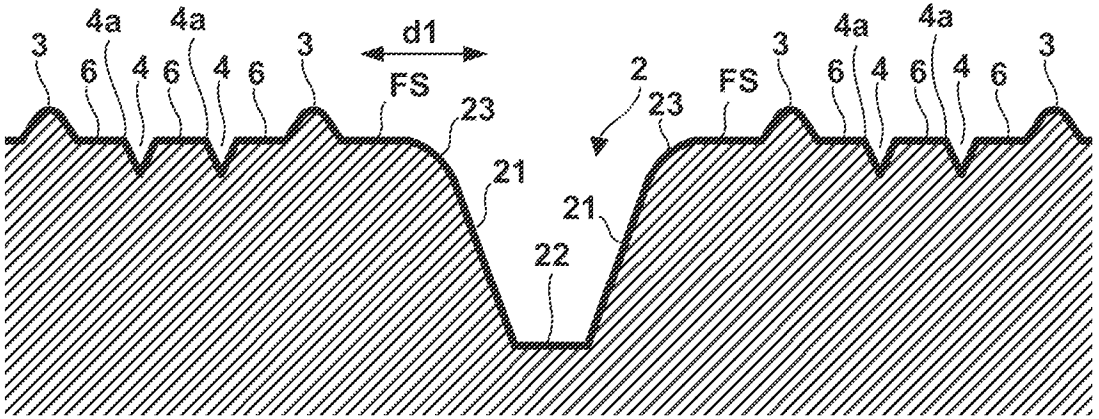
FIG. 3B is a sectional view showing another formation example of concave portions.

The score lines 2, the convex portions 3, and the concave portions 4 will be described with reference to FIGS. 1 to 3A. FIG. 2 is a partial sectional perspective view of the golf club head A, and illustrates a part of the face portion 1 taken by cutting along the d1 direction and the d2 direction. FIG. 3A is a sectional view of the golf club head A taken along a line I-I in FIG. 1.

The respective score lines 2 are linear grooves extending in the d2 direction. The plurality of score lines 2 are aligned parallel to each other in the d1 direction. Although the score lines 2 are aligned at equal intervals (equal pitches) in this embodiment, they may be aligned at different intervals. In this embodiment, each score line 2 has the same cross-sectional shape throughout its entire longitudinal portion except for its two ends (toe- and heel-side ends). Also, the score lines 2 have the same cross-sectional shape.

Each score line 2 includes a pair of side walls (side portions) 21 and a bottom wall (bottom portion) 22, and has a trapezoidal cross-sectional shape bilaterally symmetric about a center line in the d1 direction. Note that the cross-sectional shape of the score line 2 is not limited to a trapezoidal shape, and may be other shapes such as a V shape. Rounded portions are formed on edges 23 of each score line 2. The radius of the rounded portion is, for example, 0.05 mm (inclusive) to 0.3 mm (inclusive). The face portion 1 includes a reference plane FS. The reference plane FS is a flat plane and includes portions adjacent to the edges 23 of the score lines 2. In other word, a virtual plane including the planes adjacent to the edges 23 is the reference plane FS.

A depth Ds of the score line 2 (the distance between the bottom wall 22 and the reference plane FS) is preferably 0.3 mm or more. When the golf club head A is intended for athletics, the depth Ds is set to 0.5 mm or less to comply with a relevant rule. A width Ws (the width defined by the 30-degree measurement rule) of the score line 2 is preferably 0.6 mm or more. When the golf club head A is intended for athletics, the width Ws is set to 0.9 mm or less to comply with a relevant rule.

The respective convex portions 3 are protrusions protruding from the reference plane FS and extending in the d2 direction. At the time of striking a golf ball, its surface is readily caught between the convex portions 3 so that the spin amount can be increased. In this embodiment, each convex portion 3 is formed as a continuous linear protrusion without a break. However, each convex portion 3 may be formed with a break at a midway portion.

In this embodiment, the respective convex portions 3 extend parallel to the score lines 2. However, the respective convex portions 3 may extend obliquely with respect to the score lines 2. In this embodiment, a plurality of arrays of convex portions 3 (three arrays of convex portions 3 in this example) are formed between two score lines 2 adjacent to each other in the d1 direction. The height (a protruding amount from the reference plane FS) of the convex portion 3 is, for example, 10 μm to 25 μm. The width (the width in the d1 direction on the reference plane FS) of the convex portion 3 is, for example, 100 μm to 600 μm. The cross-sectional shape of the convex portion 3 in the d1 direction in this embodiment is a chevron shape. However, the cross-sectional shape of the convex portion 3 may be a rectangle or a circular arced shape. In this embodiment, the convex portions 3 are aligned at equal pitches in the d1 direction, and the pitch is, for example, 400 μm to 1,000 μm.

Each concave portion 4 is a groove recessed from the reference plane FS and extends in the d2 direction. In this embodiment, the concave portion 4 extends linearly and parallel to the score line 2 and the convex portion 3. However, the extending direction of the concave portion 4 may be oblique with respect to the d1 direction, and the concave portion 4 may be formed to meander in the d2 direction.

Each concave portion 4 extends in the d2 direction between two convex portions 3 adjacent to each other in the d1 direction. In the example shown in FIGS. 1 to 3A, one concave portion 4 is formed between two convex portions 3 adjacent to each other in the d1 direction. In this embodiment, each concave portion 4 is formed as a continuous linear groove without a break. However, each concave portion 4 may be formed with a break at a midway portion.

Since the concave portions 4 are provided, water (such as rainwater) on the face portion 1 would readily flow into the concave portions 4 so that the drainage performance of the face portion 1 can be improved. The improvement in the drainage performance of the face portion 1 enhances the effect of suppressing a decrease in back spin amount in, for example, rainy weather.

The depth of the concave portion 4 (the distance from the reference plane FS to the deepest part of the concave portion 4) is, for example, 5 μm to 25 μm. The width (the width on the reference plane FS in the d2 direction) of the concave portion 4 is, for example, 30 μm to 200 μm. In this embodiment, the cross-sectional shape of the concave portion 4 along the d2 direction is a triangular shape, and particularly an isosceles triangular shape (V shape). The isosceles triangular cross-sectional shape of the concave portion 4 makes it possible to form a narrower water channel. In addition to facilitate a capillary phenomenon, this can prevent dust such as grass from clogging in the concave portion 4. However, the cross-sectional shape of the concave portion 4 may be a rectangle or a circular arced shape.

Each flat surface 6 is formed between the concave portion 4 and the convex portion 3 adjacent to that concave portion 4. In this embodiment, the flat surface 6 is on the same plane as the reference plane FS. Since a space in the d1 direction is formed between the convex portion 3 and the concave portion 4 by forming the flat surface 6, an edge 4*a* of that concave portion 4 becomes readily caught on the surface of a golf ball bitten between the convex portions 3 upon a shot so that the spin amount can be increased. The width of the flat surface 6 in the d1 direction is, for example, 50 μm to 200 μm.

As described above, in this embodiment, the convex portion 3 and the concave portion 4 are formed and the flat surface 6 is formed between the convex portion 3 and the concave portion 4 so that an increase in back spin amount can be achieved. That is, improvement in the spin amount on a struck ball can be achieved.

Note that in this embodiment, one concave portion 4 is formed between two convex portions 3 adjacent to each other in the d1 direction in the example shown in FIGS. 1 to 3A. However, a plurality of concave portions 4 (two concave portions 4 in an example shown in FIG. 3B) may be formed as shown in the example shown in FIG. 3B. In the example shown in FIG. 3B, the flat surface 6 is also formed between two adjacent concave portions 4. With this arrangement, the edge 4*a* of each concave portion 4 readily gets caught on the surface of a golf ball upon a shot so that the spin amount can be further increased.

A manufacturing method of the golf club head A, and particularly a formation method of the convex portions 3 and the concave portions 4 will be described next. As the golf club head A, for example, a primary molded product without the convex portions 3 and the concave portions 4 is manufactured by forging or casting. Then, the convex portions 3 and the concave portions 4 are formed in the primary molded product. After that, coating and a surface treatment are performed to complete the golf club head A. The primary molded product may be formed with or without the score lines 2. When the primary molded product includes no score line 2, it is possible to form the score lines 2 upon forming the convex portions 3 and the concave portions 4. The primary molded product may be formed from a single member or multiple members. When the primary molded product is formed from multiple members, it may be formed from, for example, a face forming member which forms the face portion 1 and a head body which forms the part other than the face portion 1. In this case, the face forming member and the head body may be combined after the convex portions 3 and the concave portions 4 are formed in the face forming member.

Figure 4A:
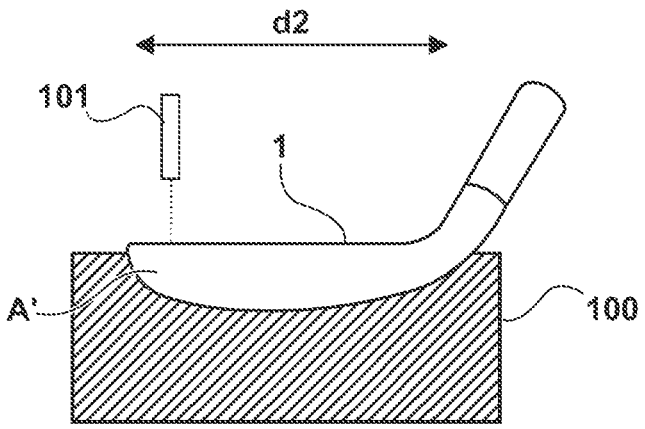
FIGS. 4A to 4C are views showing another formation example of convex portions and concave portions.
Figure 4B:
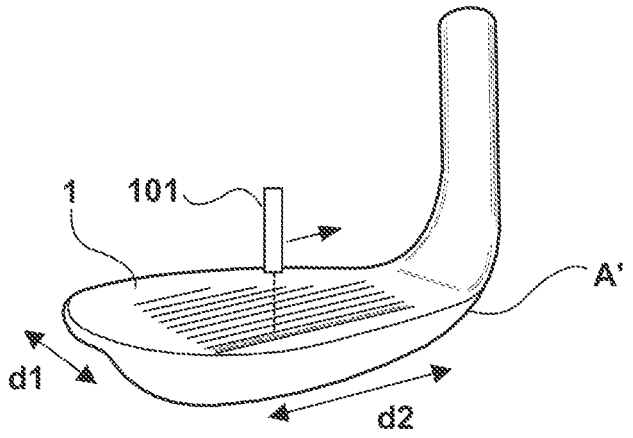

The convex portions 3 and the concave portions 4 can be formed by laser processing or cutting. FIGS. 4A and 4B exemplify a case in which the convex portions 3 and the concave portions 4 are formed by laser processing. A primary molded product A' in which the convex portions 3 and the concave portions 4 are to be formed is fixed to a laser irradiation device (not shown) via a jig 100. The laser irradiation device includes an irradiation unit 101 which emits laser light. In the example shown in FIGS. 1 to 3B, the convex portions 3 are formed while irradiating the face portion 1 with laser light emitted by the irradiation unit 101, and relatively moving the face portion 1 (primary molded product A') or irradiation unit 101 in the d2 direction. In addition, the concave portions 4 are formed while irradiating the face portion 1 with laser light emitted by the irradiation unit 101, and relatively moving the face portion 1 (primary molded product A') or irradiation unit 101 in the d2 direction.

Figure 4C:
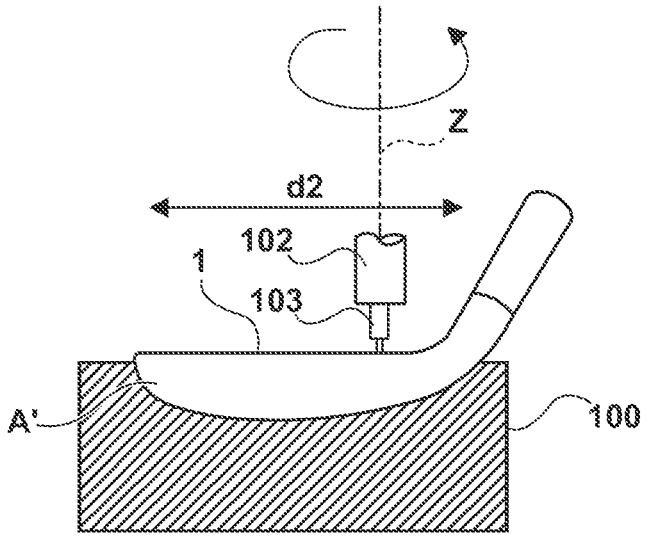

FIG. 4C exemplifies a case in which the convex portions 3 and the concave portions 4 are formed by cutting. The primary molded product A' is fixed to an NC milling machine via the jig 100. The NC milling machine includes a spindle 102 that is rotatably driven about the Z-axis, and a cutting tool (end mill) 103 is attached to the lower end of the spindle 102. As in the case of laser processing, in the example shown in FIGS. 1 to 3B, the convex portions 3 are formed while relatively moving the face portion 1 (primary molded product A') or cutting tool 103 in the d2 direction. In addition, the concave portions 4 are formed while relatively moving the face portion 1 (primary molded product A') or cutting tool 103 in the d1 direction. The concave portions 4 are formed while relatively moving the face portion 1 (primary molded product A') or cutting tool 103 on circular arc tracks.

Note that the formation method may be different between the convex portions 3 and the concave portions 4. For example, the convex portions 3 may be formed by cutting, and the concave portions 4 may be formed by laser processing. The concave portions 4 are preferably formed by laser processing using laser with a short pulse width. This can suppress the thermal effect due to laser irradiation, thereby facilitating formation of thinner grooves.

Note that after the formation of the convex portions 3 and the concave portions 4, a surface treatment for increasing the hardness of the face portion 1 is preferably performed. Examples of such a surface treatment are a carburizing treatment, nitriding treatment, soft nitriding treatment, PVD (Physical Vapor Deposition) treatment, ion plating, DLC (Diamond-Like Carbon) treatment, and plating treatment. Especially surface treatments such as a carburizing treatment and nitriding treatment, which modify the surface without forming another metal layer on the surface, are preferable. The surface of the face portion 1 may be covered with a plating layer.

Then, the surface of the face portion 1 may be covered with a plating layer. However, when covered with a plating layer, the edge 4*a* of the concave portion 4 may be rounded with the plating layer so it becomes hard to get caught on the surface of a golf ball. Therefore, the concave portions 4 may be formed after covering the base material of the face portion 1 with a plating layer.

Figure 5A:
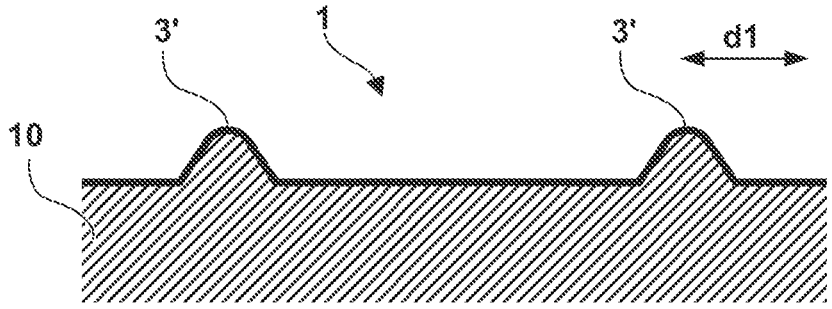
FIGS. 5A to 5C are views showing a manufacturing method when providing a plating layer.
Figure 5B:
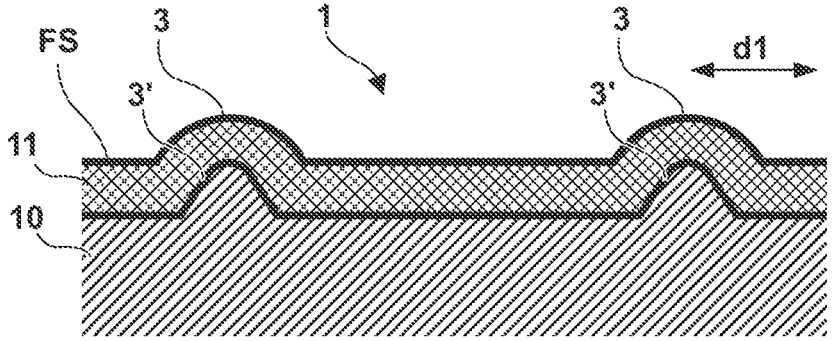
Figure 5C:
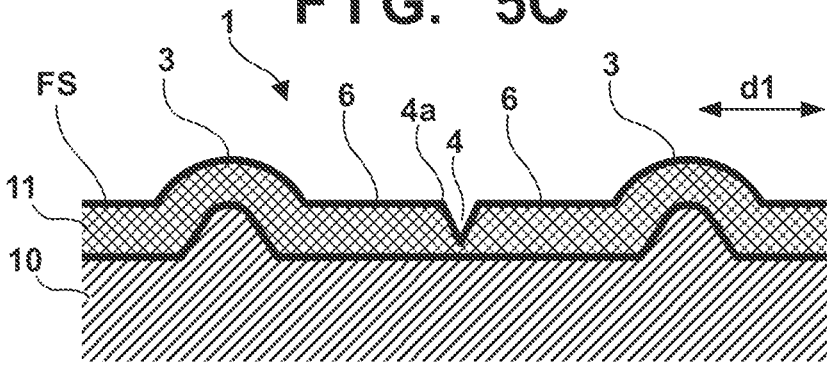

FIGS. 5A to 5C show an example of covering with a plating layer and forming the concave portion 4. FIG. 5A shows a base material 10 of the face portion 1. Examples of the material of the base material 10 are soft iron and stainless steel. FIG. 5A shows a stage in which convex portions 3' serving as the base of the convex portions 3 are formed in the base material 10. This corresponds to the stage in which the convex portions 3 are formed by laser processing or machining in the example shown in FIGS. 4A to 4C. The concave portions 4 have not been formed yet. Although not shown, grooves serving as the base of the score lines 2 have been already formed.

Then, as shown FIG. 5B, the surface of the base material 10 is covered with a plating layer 11. Examples of the material of the plating layer 11 are nickel, copper, and zinc. The thickness of the plating layer 11 is, for example, 5 μm to 50 μm. When the surface of the base material 10 is covered with the plating layer 11, the final convex portions 3 and the reference plane FS would be formed. The reference plane FS is formed by the surface of the plating layer 11. Although not shown, grooves serving as the base of the score lines 2 are also covered with the plating layer 11 so that the final score lines 2 are formed.

Then, as shown in FIG. 5C, the concave portion 4 is formed in the plating layer 11. The concave portion 4 is formed by, for example, laser processing. When the concave portion 4 is formed in the plating layer 11, the edge 4*a* of the concave portion 4 becomes a sharp corner compared with a case in which the plating layer 11 is formed after forming the concave portion 4 in the base material 10. Therefore, the edge 4*a* more readily gets caught on the surface of a golf ball upon a shot. The surface of the plating layer 11 forms the flat surfaces 6. FIGS. 5A to 5C describe a case in which the flat surfaces 6 are formed, but a method of processing concave portions after forming a plating layer is also applicable to an arrangement in which the face portion 1 has no flat surface 6.

Figure 6A:
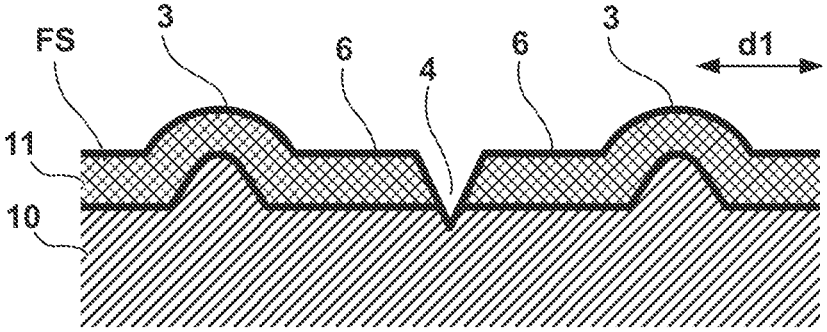
FIGS. 6A and 6B are views each showing another arrangement example in which a plating layer is provided.

In the example shown in FIG. 5C, the concave portion 4 is not formed in the base material 10 but formed only in the plating layer 11. That is, the depth of the concave portion 4 (the distance from the reference plane FS to the deepest part of the concave portion 4) is smaller than the thickness of the plating layer 11. Since the base material 10 is not exposed outside in the concave portion 4, the base material 10 can be protected by the plating layer 11 and an excellent appearance can be provided. However, an arrangement in which the concave portion 4 reaches the base material 10 as in an example shown in FIG. 6A is also adoptable. In this case, it is possible to make the concave portion 4 deeper so that the drainage performance of the face portion 1 can be improved.

Figure 6B:
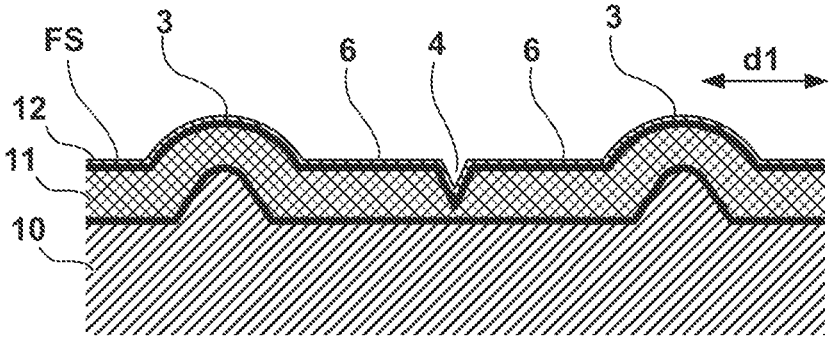

The plating layer 11 may be further covered with another plating layer made of different material. FIG. 6B shows its example. In the example shown in FIG. 6B, the plating layer 11 is covered with a plating layer 12. Examples of the material of the plating layer 12 are chromium, zinc, and tin. The thickness of the plating layer 12 is smaller than that of the plating layer 11 and is, for example, 0.1 μm to 10 μm.

The ratio of the thickness of the plating layer 11 and that of the plating layer 12 is, for example, 1:0.2 to 1:0.02.

When the surface of the base material 10 is covered with the plating layers 11 and 12, the final score lines 2, concave portions 3, convex portions 4, reference plane FS, and flat surfaces 6 would be formed. The reference plane FS and the flat surfaces 6 are formed by the surface of the plating layer 12. The depth of the final concave portion 4 is smaller than the thickness of the plating layer 11 and larger than the thickness of the plating layer 12.

When the plating layer 12 is formed after forming the concave portions 4, the edges 4*a* of the concave portions 4 are slightly rounded by the plating layer 12. However, since the plating layer 12 is thin so it does not largely decrease a catch of the edge 4*a* on the surface of a golf ball upon a shot. When the plating layer 12 is formed as the finish of the surface of the face portion 1, its corrosion resistance and design can be improved. The plating layer 12 may be formed in the example shown in FIG. 6A.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A golf club head that includes a face portion, comprising:

a plurality of score lines formed in the face portion and extending in a toe-heel direction;

a plurality of convex portions formed in the face portion and extending in the toe-heel direction between the score lines adjacent to each other in a vertical direction of the face portion; and at least one concave portion formed in the face portion and extending in the toe-heel direction between the convex portions adjacent to each other in the vertical direction, wherein a flat surface is formed on each side with respect to the concave portion in the vertical direction to separate the concave portion from the convex portions, a width of the flat surface in the vertical direction is 50 μm to 200 μm, and two concave portions, as the at least one concave portion, are formed between the convex portions adjacent to each other in the vertical direction.

2. The golf club head according to claim 1, wherein the flat surface is on the same plane as a plane adjacent to edges of the plurality of score lines in the vertical direction.

* * * * *